US006000728A

United States Patent [19]

Mowry, Jr.

[11] Patent Number: 6,000,728

[45] Date of Patent: Dec. 14, 1999

[54] SECURITY DOCUMENT

[75] Inventor: William H. Mowry, Jr., Dayton, Ohio

[73] Assignee: The Standard Register Company, Dayton, Ohio

[21] Appl. No.: 08/185,362

[22] Filed: Jan. 24, 1994

Related U.S. Application Data

[63] Continuation-in-part of application No. 08/024,666, Mar. 1, 1993, Pat. No. 5,340,159, which is a continuation-in-part of application No. 07/729,363, Jul. 12, 1991, Pat. No. 5,197,765.

[51] Int. Cl.[6] ..... B42D 15/00

[52] U.S. Cl. ..... 283/393; 283/94; 283/95; 283/902; 428/195; 428/201; 428/915; 428/916

[58] Field of Search ..... 283/93, 94, 95, 283/902; 428/195, 201, 915, 916

[56] References Cited

U.S. PATENT DOCUMENTS

| | | | |
|---|---|---|---|
| 3,675,948 | 7/1972 | Wicker . | |
| 3,784,289 | 1/1974 | Wicker . | |
| 4,168,088 | 9/1979 | Somlyody | 283/902 X |
| 4,210,346 | 7/1980 | Mowry, Jr. et al. | 283/902 X |
| 4,227,719 | 10/1980 | McElligott et al. . | |
| 4,227,720 | 10/1980 | Mowry, Jr. et al. | 283/902 X |
| 4,265,469 | 5/1981 | Mowry, Jr. et al. . | |
| 4,310,180 | 1/1982 | Mowry, Jr. et al. | 283/902 X |
| 4,341,404 | 7/1982 | Mowry, Jr. et al. . | |
| 4,351,547 | 9/1982 | Brooks, II | 283/902 X |
| 4,360,548 | 11/1982 | Skees et al. . | |
| 4,420,175 | 12/1983 | Mowry, Jr. et al. | 283/902 X |
| 4,579,370 | 4/1986 | Corwin et al. | 283/94 X |
| 4,582,346 | 4/1986 | Caprio et al. | 283/902 X |
| 4,662,651 | 5/1987 | Mowry, Jr. . | |
| 4,733,887 | 3/1988 | Mowry, Jr. . | |
| 5,018,767 | 5/1991 | Wicker . | |
| 5,074,596 | 12/1991 | Castagnoli | 283/902 X |
| 5,149,140 | 9/1992 | Mowry, Jr. et al. | 283/902 X |
| 5,297,815 | 3/1994 | Anderson et al. | 283/902 X |

FOREIGN PATENT DOCUMENTS

| | | | |
|---|---|---|---|
| 204552 | 12/1986 | European Pat. Off. | 283/93 |
| 3831688 | 3/1990 | Germany | 283/93 |
| 79991 | 5/1985 | Japan | 283/902 |
| 1205179 | 9/1986 | Japan | 283/902 |
| 406079992 | 3/1994 | Japan | 283/902 |
| 2217258 | 10/1989 | United Kingdom | 283/93 |

*Primary Examiner*—Andrea L. Pitts
*Assistant Examiner*—Monica Smith
*Attorney, Agent, or Firm*—Killworth, Gottman, Hagan, Schaeff LLP

[57] ABSTRACT

A security document according to the present invention includes a document substrate having a surface for receiving printed indicia. A half tone warning image is printed on first areas of the surface and a half-tone background image is printed in second areas surrounding the first areas. The half-tone a warning image includes at least one word indicating a status of a copy of the document. A camouflage image extending over the document surface for confusing the eye of an observer such that said warning image is not readily observed. The camouflage image includes at least one word indicating to an observer a status of the original document. One of the half-tone warning image and the half-tone background image are printed with half-tone elements of such a line spacing and element size that it is not readily reproducible by a photocopier. As a consequence, the half-tone warning image becomes apparent on photocopies of the original document.

23 Claims, 16 Drawing Sheets

SECURITY DOCUMENT

RELATED PATENT APPLICATIONS

This is a continuation-in-part of U.S. patent application Ser. No. 08/024,666, filed Mar. 1, 1993, now U.S. Pat. No. 5,340,159 entitled VARYING TONE SECURITY DOCUMENT, which in turn is a continuation-in-part of U.S. patent application Ser. No. 07/729,363, filed Jul. 12, 1991, entitled VARYING TONE SECURITY DOCUMENT, now U.S. Pat. No. 5,197,765, issued Mar. 30, 1993.

BACKGROUND OF THE INVENTION

The importance of making various types of documents safe from nefarious duplication is readily apparent. The development of the color copier has resulted in significant concern in this regard. The quality of color reproductions that can be made with a color copier has become so good that it may be very difficult to distinguish original documents from color reproductions. Even if a reproduction is not an exact copy, the reproduction often appears reasonably authentic in the absence of the original for comparison purposes. As a consequence, there has been concern that color copiers could be used to reproduce security documents, such as checks, stock certificates, automobile title instruments, and other documents of value, for illegal purposes. This concern has been heightened with the advent of desk top publishing software and hardware, including personal computers and scanners. Such desk top publishing systems allow sophisticated image processing and printing not previously generally available.

Many techniques have been developed to prevent improper reproduction of security documents. One of the most successful is the use of a hidden warning message which is readily apparent on reproduced copies of a document, but which is invisible, or nearly so, on the original document.

Examples of this technique are shown in U.S. Pat. Nos. 4,227,720 and 4,310,180. A single tone warning phrase and a single tone background pattern are used. Tone refers to the visual effect produced by solid ink coverage or by half-tone dots, bars, or marks which cover a portion of a printed area and which usually have a frequency that is measured in dots, lines, or marks per inch. Half-tone dots, bars, or marks may be more or less uniformly distributed over an area to produce the visual effect, i.e., less than full tone, of a lighter overall color with the use of a darker color ink printed at less than full area coverage. The warning phrase and background pattern area tones are of different frequencies and are made up of dots, bars, or marks of different sizes, but they are selected to provide similar appearance to the eye of a casual observer. A less than full tone effect may also be produced by full area coverage of a paler color of ink than the darker color of ink used for the half-tone dots, bars, or marks.

Because the tone of the warning phrase and the tone of the background pattern surrounding the warning phrase on the original document are selected to be the same, these two areas have much the same visual impact on an observer, and the warning phrase is not readily perceived. The optics of color copiers have typically been unable to reproduce relatively small half-tone dots, lines or other elements. As a consequence, reproduced copies of the original document will have a noticeable warning phrase.

A camouflage pattern is sometimes utilized to obscure the warning phrase further. The camouflage pattern may be defined by areas in which the dots, bars, or marks have been deleted from both the warning phrase and the background pattern. The camouflage pattern may also be defined by a pattern of dots, bars, or marks which are smaller than or larger than those used in the background pattern and the warning phrase, or by areas of complete coverage of a paler ink. The patterns of such camouflage images have commonly been decorative, although some camouflage images have been utilized which identify the organization producing the document. Such a camouflage image may, for example, be a variation of the company logo, or letters spelling out the name of the company.

In recent years, color copiers have been improved substantially. These new color copiers have made the above technique less effective in protecting documents. By manipulating the control settings on such copiers, copies can be made of such documents in which the warning phrase does not appear on reproductions when some of the most commonly used frequency and size combinations are used. Furthermore, desk top publishing systems now available in conjunction with laser printers, offer additional possibilities for unauthorized copying. Therefore, it is clear that improvements in this technique are desirable.

One such improvement is shown in U.S. Pat. No. 4,351,547, which also utilizes a single tone background and a single tone cancellation phrase. In this improved technique, the warning phrase is not defined by dots or elements of the same size and frequency. Instead, the warning phrase is defined by an alternating element pattern which includes large elements of lower frequency than the background tone, and small elements located in exact registry with the large elements.

U.S. Pat. No. 4,579,370 represents another improvement in the use of a hidden warning phrase. The background and warning phrase are each made up of half-tone elements of two pairs of element sizes. For example, the background might be made with about 50% of 130 lines per inch, 0.005 inch diameter, and the balance of 130 lines per inch, 0.006 inch diameter; the cancellation term might be made with about 50% of the elements of 65 lines per inch, 0.010 inch diameter and the balance of 65 lines per inch, 0.012 inch diameter. This provides additional protection for documents against improper copying.

These methods have generally been successful in protecting documents at most copier settings. However, by adjusting the settings for sharpness and lightness/darkness it has still been possible on some copiers for a skilled individual to produce a copy in which the warning phrase is not visible.

Furthermore, while the technique of hiding a cancellation or warning phrase within a background image has provided an indication on the face of copies that they are not original documents by indicating "VOID" or the like, there has been no corresponding indication on the original documents that they are in fact original. Rather, the recipient relied on an assessment of the overall appearance of the document, and the fact that it did not bear a visually apparent cancellation phrase or warning phrase as indications of authenticity.

Therefore, there remains a need in the art for a security document which provides improved protection against copying over a wide range of copier settings, or against manipulation using desk top publishing systems.

SUMMARY OF THE INVENTION

These needs are met by a security document according to the present invention which includes a document substrate having a surface for receiving printed indicia. A half-tone warning image is printed in first areas on the surface. The warning image comprises at least one word indicating that a copy of the document is not an original document. A half-tone background image is printed in second areas on the surface. The second areas surround the first areas. Finally, a camouflage image extends over the document surface; the camouflage image confuses the eye of an observer such that the warning image is not readily observed. The camouflage image comprises at least one word indicating to an observer that the document is an original document. As will become apparent, the half-tone warning image indicates the status of a copy of the document, whereas the camouflage image indicates the status of the original document. One of the half-tone warning images and the half-tone background images is printed with half-tone elements of such a line spacing and element size that it is not readily reproducible by a copier. As a consequence, the half-tone warning image becomes apparent on a copy of an original document.

The camouflage image is defined by portions of the first areas in which half-tone elements are not printed. Alternatively, the camouflage image may be defined by portions of the second areas in which half-tone elements are not printed. Further alternatively, the camouflage image may be defined by portions of the first and second areas in which half-tone elements are not printed.

The warning image and the camouflage image may comprise words which are antonyms. Such words may include INVALID and VALID, UNAUTHORIZED and AUTHORIZED, COPY and ORIGINAL, VOID and VALID, and DUPLICATE and ORIGINAL, for example. By "word" is meant written indicia of any sort, including any recognizable character or symbol.

The sizes of the half-tone elements making up the warning image and the background image may vary across the surface such that the density of the warning image and the density of the background image vary together across the surface, thereby impeding copying the security document without the warning image being apparent on at least some portion of the copy of the security document, regardless of the copier setting adjustments that may be made.

The warning image may be substantially larger than the camouflage image, and the camouflage image may be repeated a plurality of times over the warning image. The letters of the word making up the camouflage image are preferably outlined by areas in which no half-tone elements are printed.

Accordingly, it is a object of the present invention to provide a security document in which a half-tone warning image is printed on the original document but does not become apparent except on copies that are made of the original document; to provide such a security document in which the half-tone warning image is obscured to the eye of an observer by a camouflage image, such camouflage image indicating the authentic status of the original security document; and to provide such a security document in which the half-tone warning image and the camouflage image consist of words that are antonyms.

Other objects and advantages of the invention will be apparent from the following description, the accompanying drawings and the appended claims.

DETAILED DESCRIPTION OF THE PREFERRED EMBODIMENT

Figure 1:
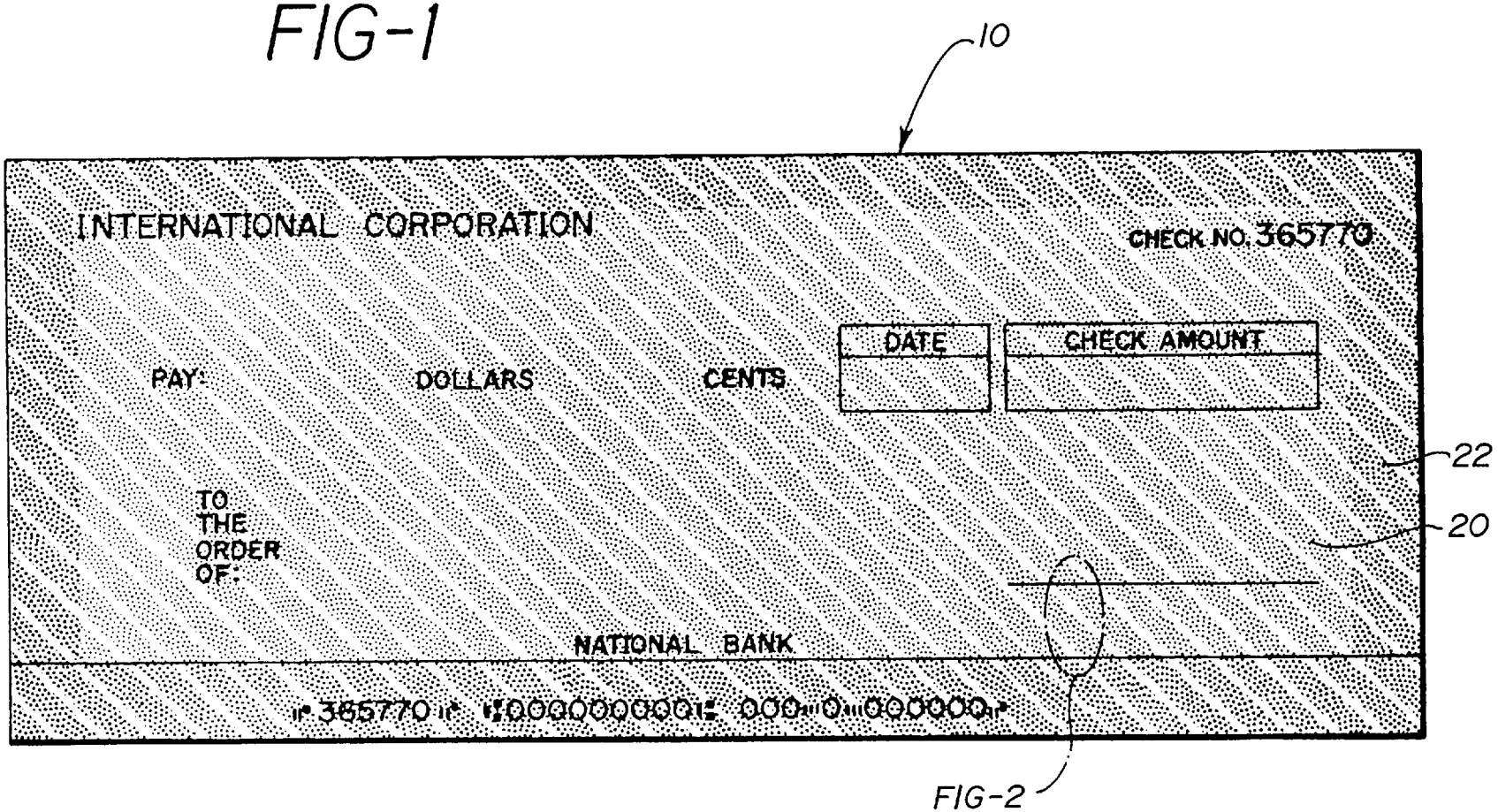
FIG. 1 illustrates a check according to the present invention as it would appear to a casual observer.

FIG. 1 illustrates a check 10 made according to the present invention, as seen by a casual observer, with a lighter tone area, first part 20, and a darker tone area, second part 22. The lighter appearance of first part 20 is due to smaller element size which results in a smaller percentage of the area of first part 20 that is covered with ink compared to second part 22. The second part 22 is shown as defining a complete border around first part 20. However, it may form only a partial border. It will be appreciated that the first part 20 may be darker than the second part 22, if desired.

Figure 2:
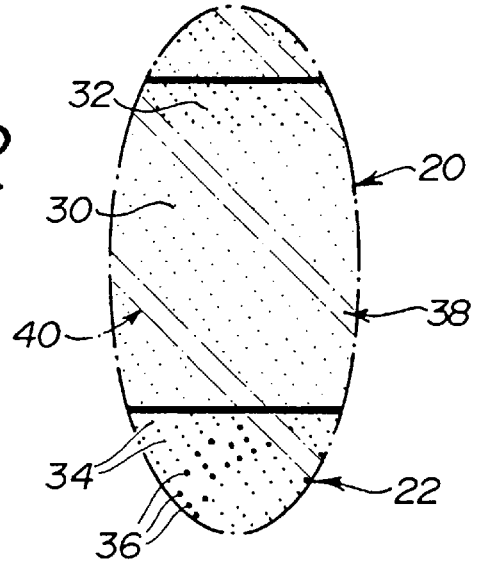
FIG. 2 is an enlarged portion of the check of FIG. 1.

FIG. 2 is a detailed illustration of a portion of check 10. FIG. 2 shows sections of first part 20 and second part 22. First part 20 contains elements of a first half-tone background image 30 and first warning phrase or half-tone warning image 32. The elements of first background matter 30 are illustrated as being smaller than those of first half-tone warning image 32, but they could be larger, as well.

Second part 22 has elements of a second half-tone background image 34 and second half-tone warning image 36. The elements of a second half-tone background image 34 are represented as being smaller than those of second half-tone warning image 36; alternatively, they could be larger, however. The elements of second half-tone background image 34 are represented as being larger than those of first half-tone background image 30, and the elements of second half-tone warning image 36 are shown as being larger than those of first half-tone warning image 32. However, they could be smaller.

The frequencies of the elements in the first and second half-tone background image may be the same or they may be different. Similarly, the frequencies of the elements of the first and second background terms may be the same or different. For instance, one useful combination would be 130 lines per inch at 10% and 65 lines per inch at 15% in the first part, and 130 lines per inch at 20% and 65 lines per inch at 25% in the second part. Another useful combination might be 130 lines per inch at 10% and 65 lines per inch at 15% for the first part, and 120 lines per inch at 20% and 60 lines per inch at 25% in the second part.

Phantom dotted lines 40 do not actually appear on the check. They have been used merely to show the edges of the camouflage image 38. The camouflage image may be defined by the absence of the elements of the first and second half-tone background images and first and second half-tone warning images. It may also be defined by the presence of elements of a larger or smaller size than the background elements.

Figure 3:
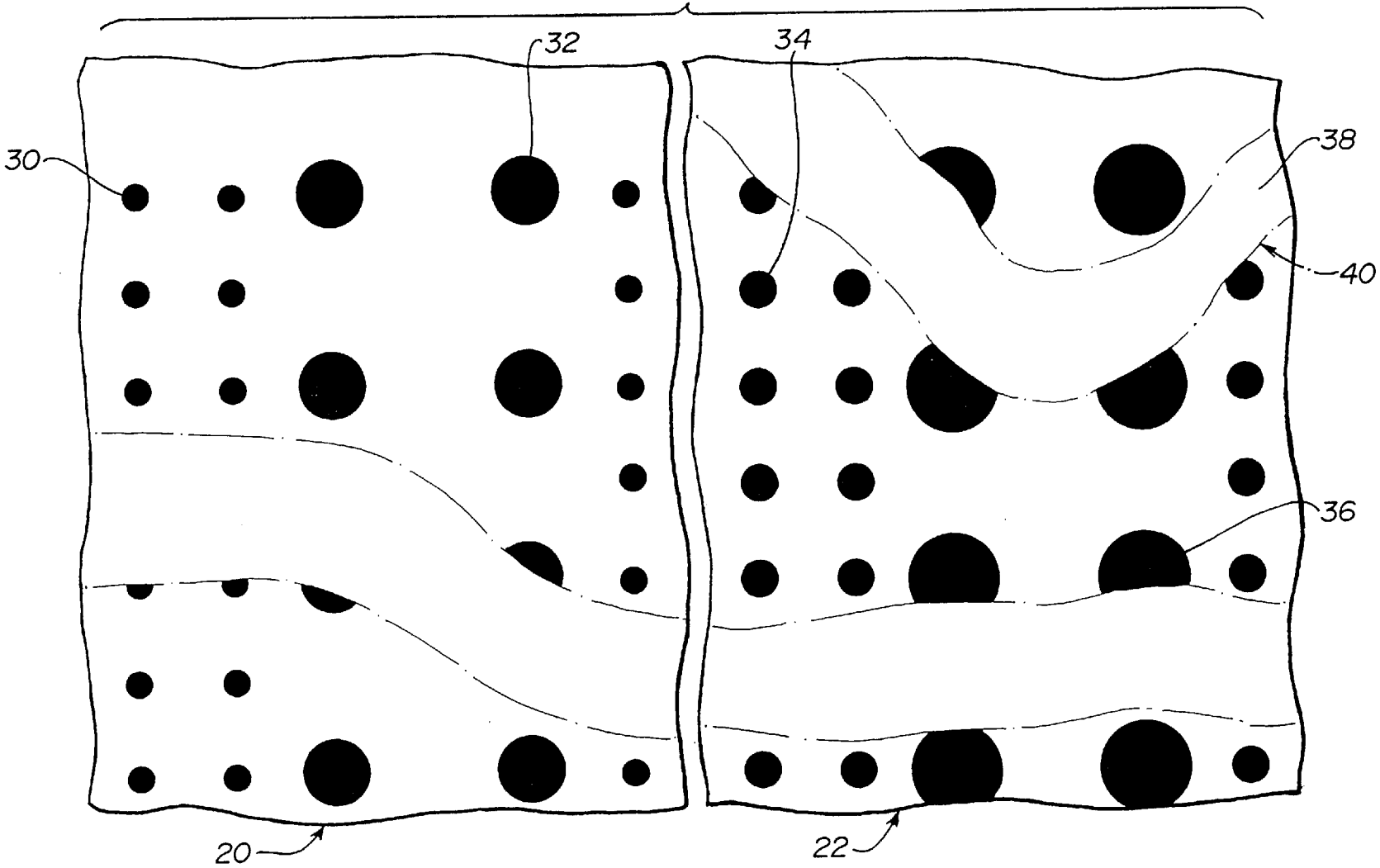
FIG. 3 is an illustration of two different areas on the surface of the document, greatly enlarged.

FIG. 3 shows an enlarged view of an area of the first part 20 and second part 22 on a different security document. The camouflage image 38 consists of wavy lines on the illustrated document. The elements of the first half-tone background image 30 are smaller than the elements of first half-tone warning image 32. The elements of second half-tone background image 34 are smaller than the elements of second half-tone warning image 36, but larger than the elements of first half-tone background image 30. The elements of second half-tone warning image 36 are larger than the elements of first half-tone warning image 32.

The frequency of the elements of the first half-tone background image 30 is the same as the frequency of the elements of the second half-tone background image 34. The frequency of the elements of first and second half-tone warning images 32 and 36 is the same, and it is less than that of first and second half-tone background image 30 and 34.

The relationship between the size and frequency of the elements explains the difference in the appearance of the two parts. First part 20 appears to be lighter in tone than second part 22 because there is a lower percentage of the document surface covered with ink in relation to the total area of the document surface in first part 20; first part 20 is therefore of a lighter tone than second part 22. This is advantageous in that if a copier is adjusted to obscure or eliminate a half-tone warning image in first part 20 of a copy, the half-tone warning image in the second part 22 will appear on the reproduced copy. Similarly, if the copier is adjusted to obscure or eliminate the half-tone warning image in the second part 22 of the copy, the half-tone warning image in first part 20 will appear on the reproduced copy.

It should be appreciated that the tone of an area of a document, that is the darkness or lightness of the document as it appears to the eye of an observer, is not a function of only density of the half-tone printing elements. It is true, however, that with a half-tone screen of a given number of lines per unit length, a greater density which results from larger half-tone elements will produce a darker tone. It has been found, however, that an area having large, widely spaced elements will appear lighter in tone than another area having smaller, more closely spaced elements, even though the amount of document surface covered by ink per unit area is the same in each instance.

Figure 4:
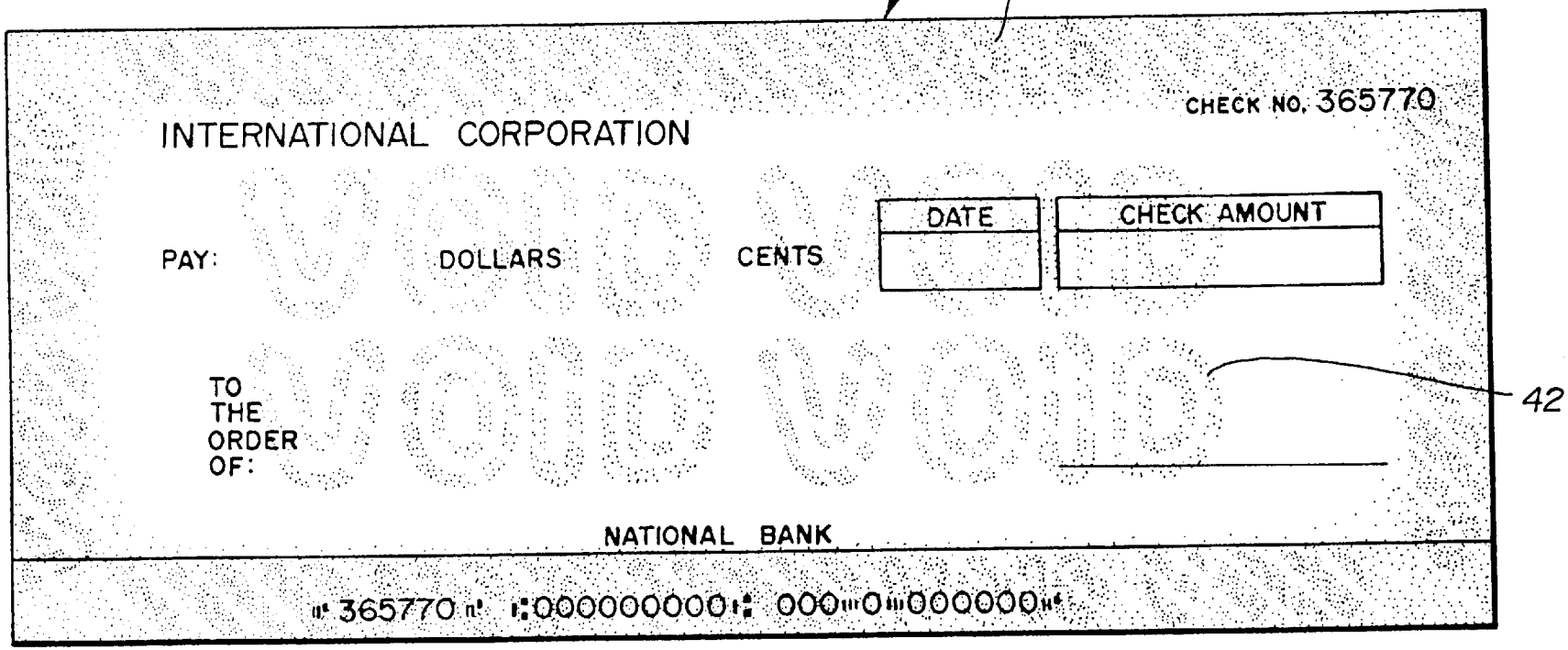
FIG. 4 illustrates the appearance of a reproduction of the document of FIG. 1 obtained on a color copier or desk top publishing system.
Figure 5:
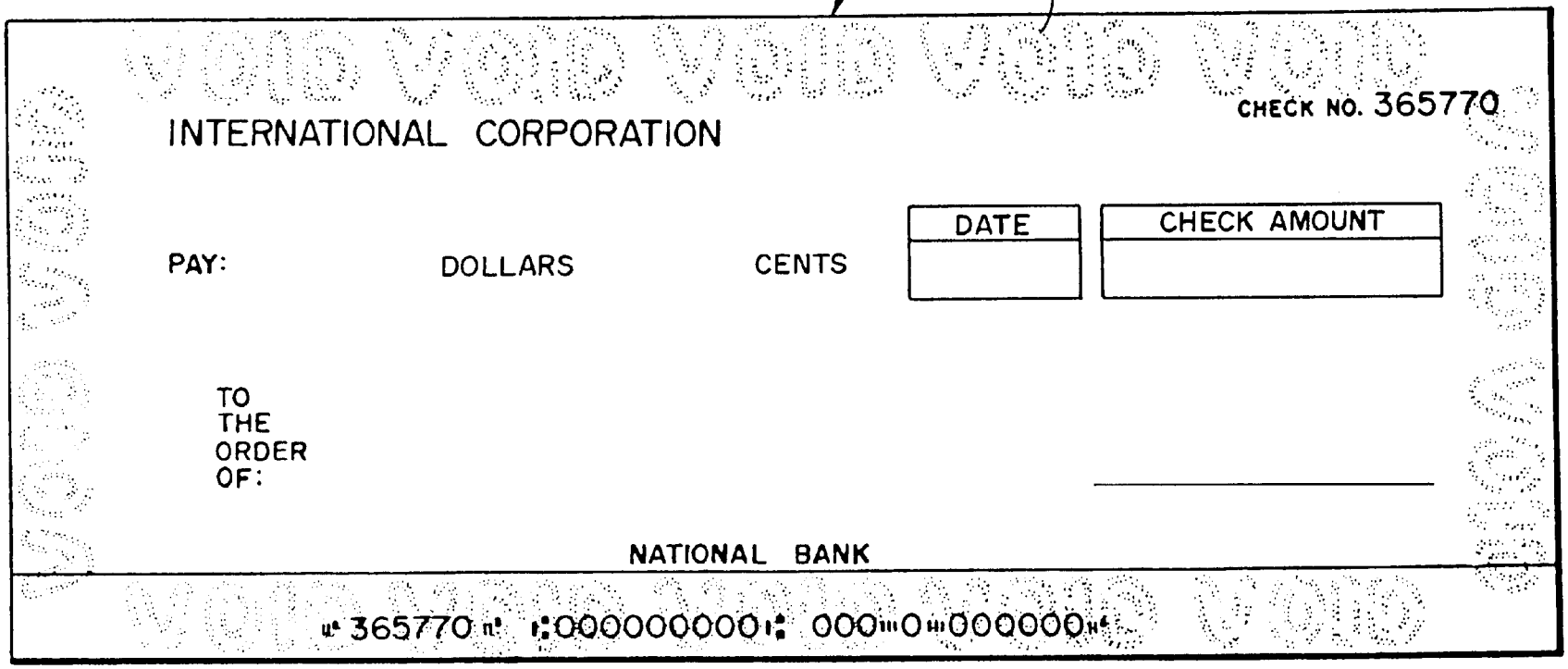
FIG. 5 is a drawing, similar to FIG. 4, illustrating the appearance of a reproduction obtained on a color copier or desk top publishing system at different control settings.
Figure 6:
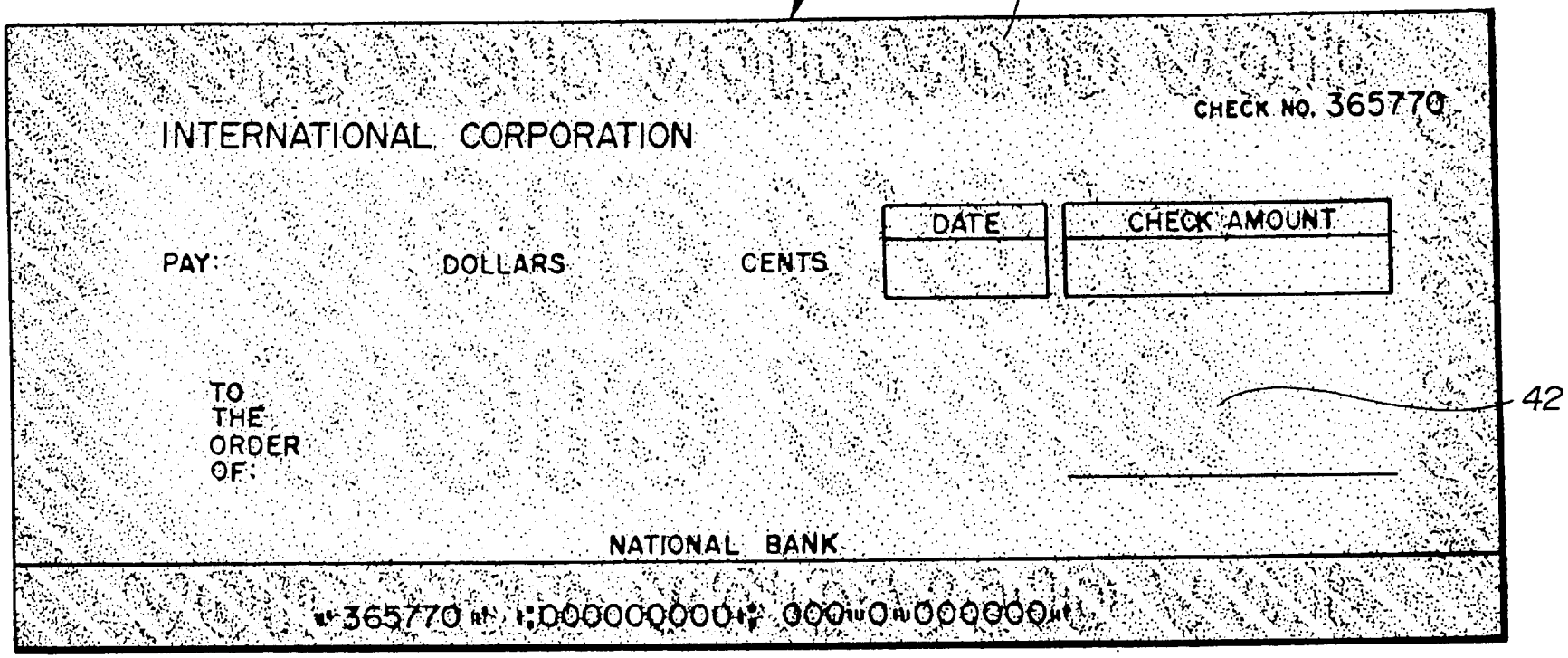
FIG. 6 is a drawing, similar to FIG. 4, illustrating the appearance of a reproduction obtained on a color copier or desk top publishing system at other control settings.

FIGS. 4, 5, and 6 represent the results of various attempts to copy the check 10 of FIGS. 1 and 2 on a color copier. In FIG. 4, when the copier is adjusted to obscure half-tone warning image 44 in second part 22, half-tone warning image 42 in first part 20 appears clearly on the reproduced copy.

In FIG. 5, if the copier is adjusted to lighten the copy to eliminate half-tone warning image 42 in first part 20, the adjustment produces a copy in which half-tone warning image 44 in second part 22 is clearly visible on the reproduced copy. Finally, in FIG. 6, when the copier is adjusted to obscure half-tone warning image 42 in first part 20 of the reproduced copy, half-tone warning image 44 in second part 22 is readily apparent on the reproduced copy.

Figure 7:
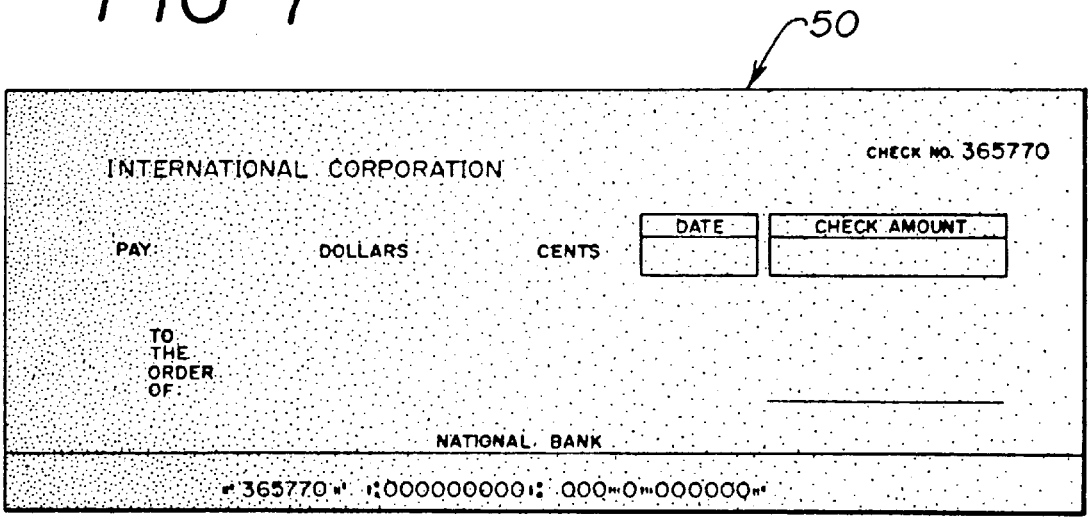
FIG. 7 is an illustration of an alternate embodiment of the present invention.

FIG. 7 shows an alternative embodiment of the present invention. The check 50 contains elements of a half-tone background image, elements of a half-tone warning image, and a camouflage image as illustrated above in respect to FIGS. 1–6. The tone of the elements varies across the face of the check 50. It could decrease from left to right as shown. This may be accomplished by varying the size of the half-tone elements, their spacing, or both, across the face of the check 50. Other variations are possible.

Figure 8:
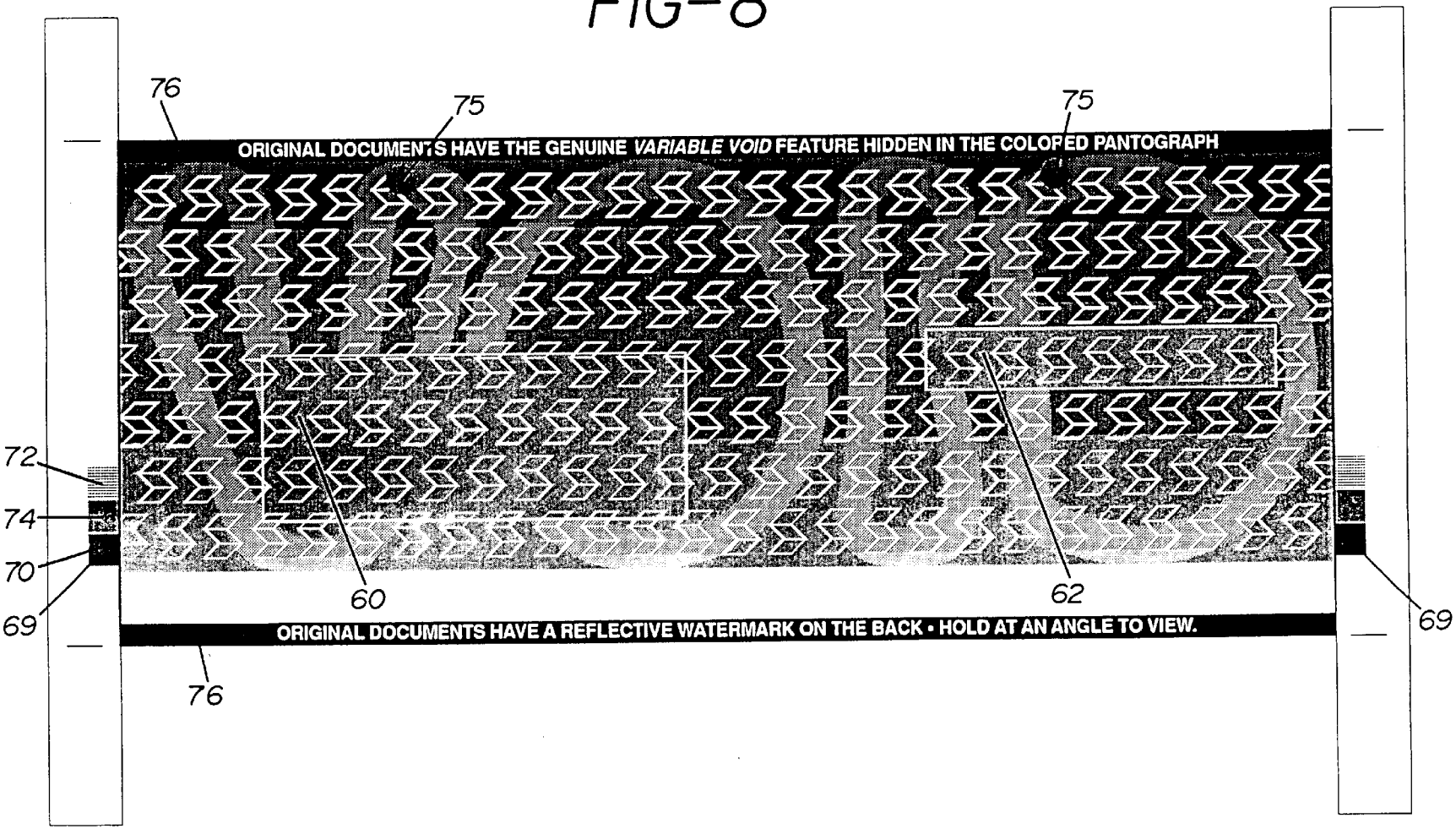
FIG. 8 is an illustration of another embodiment of the present invention.

FIG. 8 illustrates diagrammatically yet another embodiment of the present invention. In this embodiment, the frequencies of the elements of the half-tone background image and the half-tone warning images remain the same, while the size of the elements is varied across the document. This is called a graded screen. For example, the frequency might be 130 and 65 lines per inch for the half-tone background image and the half-tone warning image, respectively. The size of the elements of the half-tone background image may vary across the document from 50% of the area covered to 5%, and the half-tone warning image may vary across the document from 60% to 7%. In the illustrated document, the highest percentages of coverage are at the top of the document. These percentages are gradually reduced toward the bottom of the document. The illustrated document shows this change in coverage percentages as occurring in steps, producing bands of slightly different tone. If desired, however, the size of the elements may be continuously varied over the document surface. Regardless of the manner in which the element size of the half-tone background image and the element size of the half-tone warning image are varied, the selection of element sizes for a given area on the document is made such that they provide substantially equal tone.

The address area 60 and the amount area 62 are made of half-tone elements which are substantially the same spacing as the background elements. These areas may contain the camouflage image or the image may be omitted. The address area 60 and the amount area 62 are readable by image scanners. FIG. 8 also shows a quality control target 69 printed on the surface of the check. The quality control target comprises a high density area 70, a low density area 72, and an intermediate density area 74. Warning bands 76 of high density printing may be positioned at the top and bottom of the check 50 as shown. The low density printing may be used for portions such as the address and amount areas 60 and 62. Intermediate targets 75 may be provided in obscure areas of the form and printed without the camouflage image.

Figure 9:
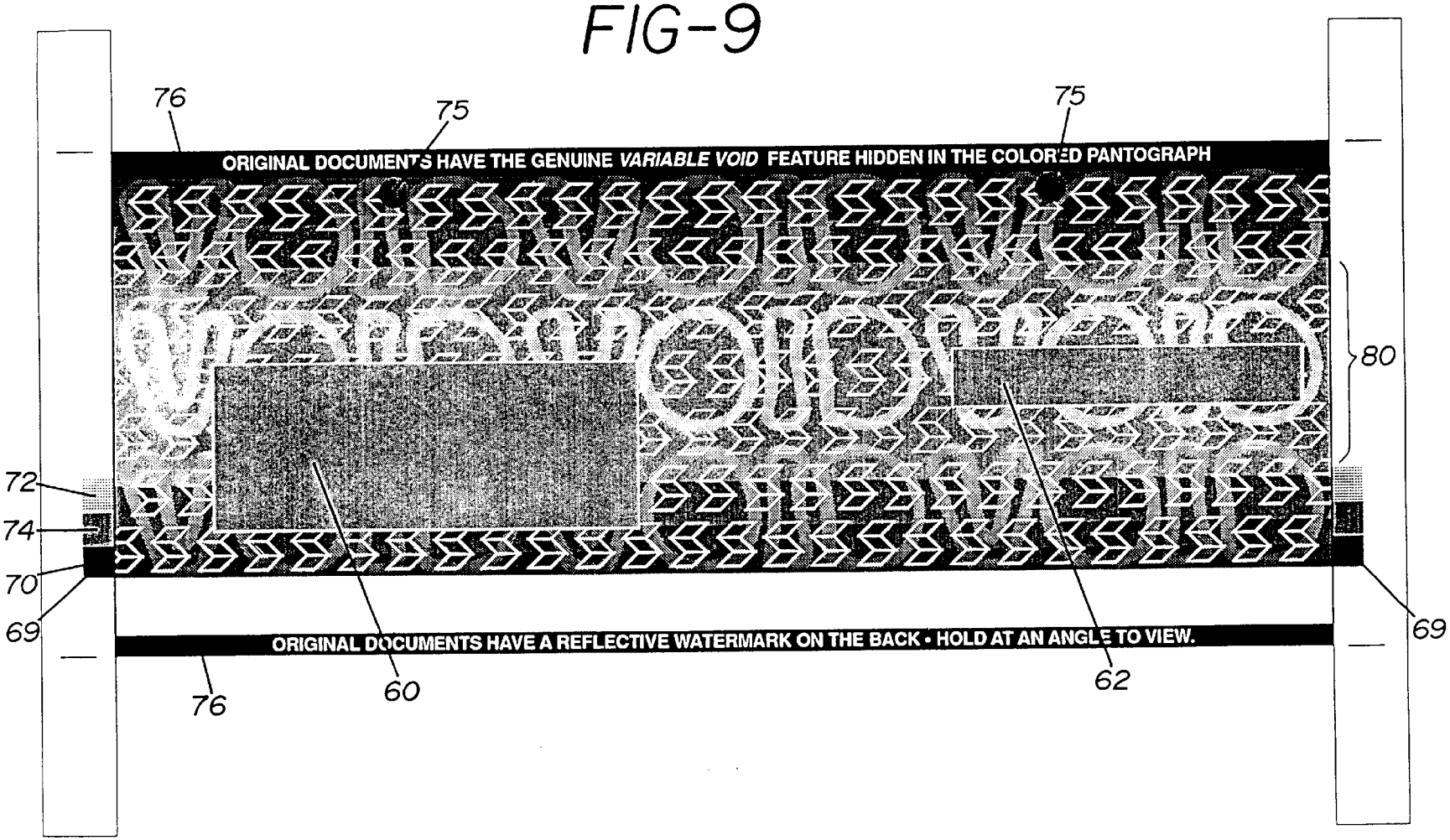
FIG. 9 is an illustration of an alternate embodiment of the present invention.

FIG. 9 illustrates diagrammatically yet another embodiment of the present invention, with parts of the document corresponding to those of FIG. 8 being labeled with like reference numerals. In the embodiment of FIG. 9, the frequencies of the elements of the half-tone background image and the half-tone warning images are constant, while the size of the elements is varied across the document. In contrast to the embodiment of FIG. 8, however, the highest percentages of coverage by screen elements occurs at both the top and bottom of the document. The percentages are gradually reduced toward a central band 80 of generally uniform tone. As with FIG. 8, FIG. 9 shows the changes in percentage coverage occurring in steps, producing bands of slightly different tone. If desired, however, the size of the elements may be continuously varied over the document surface. Once again, the selection of element sizes for given areas on the document is made such that they provide substantially equal tone.

Figure 10:
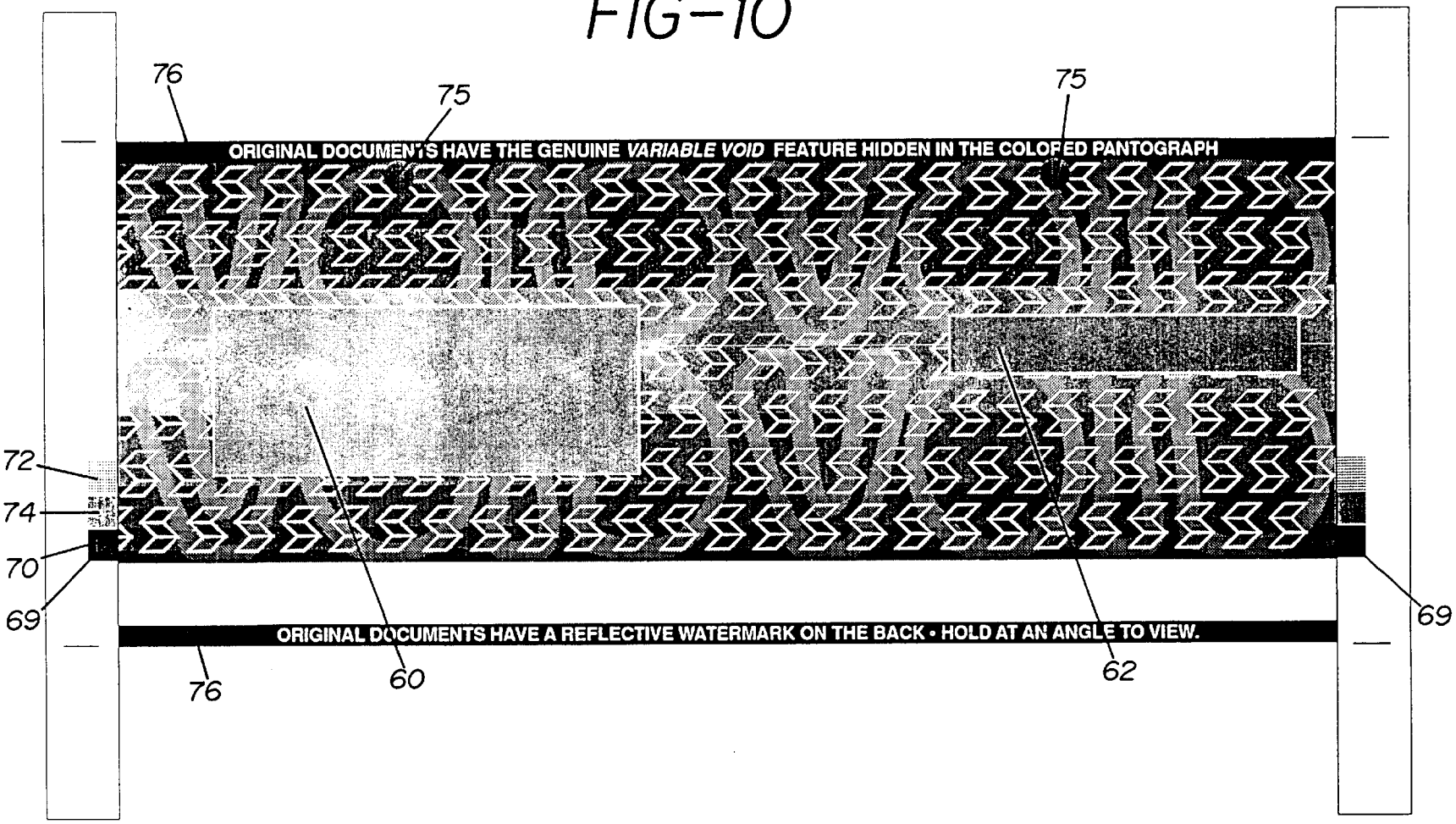
FIG. 10 is an illustration of another embodiment of the present invention.

FIG. 10 illustrates diagrammatically a further embodiment of the present invention, with parts of the document corresponding to those of FIG. 8 being labeled with like reference numerals. In the embodiment of FIG. 10, the frequencies of the elements of the half-tone background image and the half-tone warning images are constant, while the size of the elements is varied across the document. In contrast to the embodiment of FIG. 9, the embodiment of FIG. 10 does not include a central band of generally uniform tone. Rather the percentage of coverage by the screen elements gradually decreases from the top and bottom of the document to the middle of the document. As with the other embodiments, the selection of element sizes is made such that the half-tone background image and the adjacent portions of the half-tone warning images are of substantially equal tone.

It should be understood that the phrase "half-tone warning image" is intended to include not only words such as the word "VOID" shown in the drawings, but also words and phrases which simply make evident to an observer that the document being inspected is a copy of the original document. Such phrases as "PHOTOCOPY", "COPY", and "DUPLICATE" may be used for this purpose.

Figure 11:
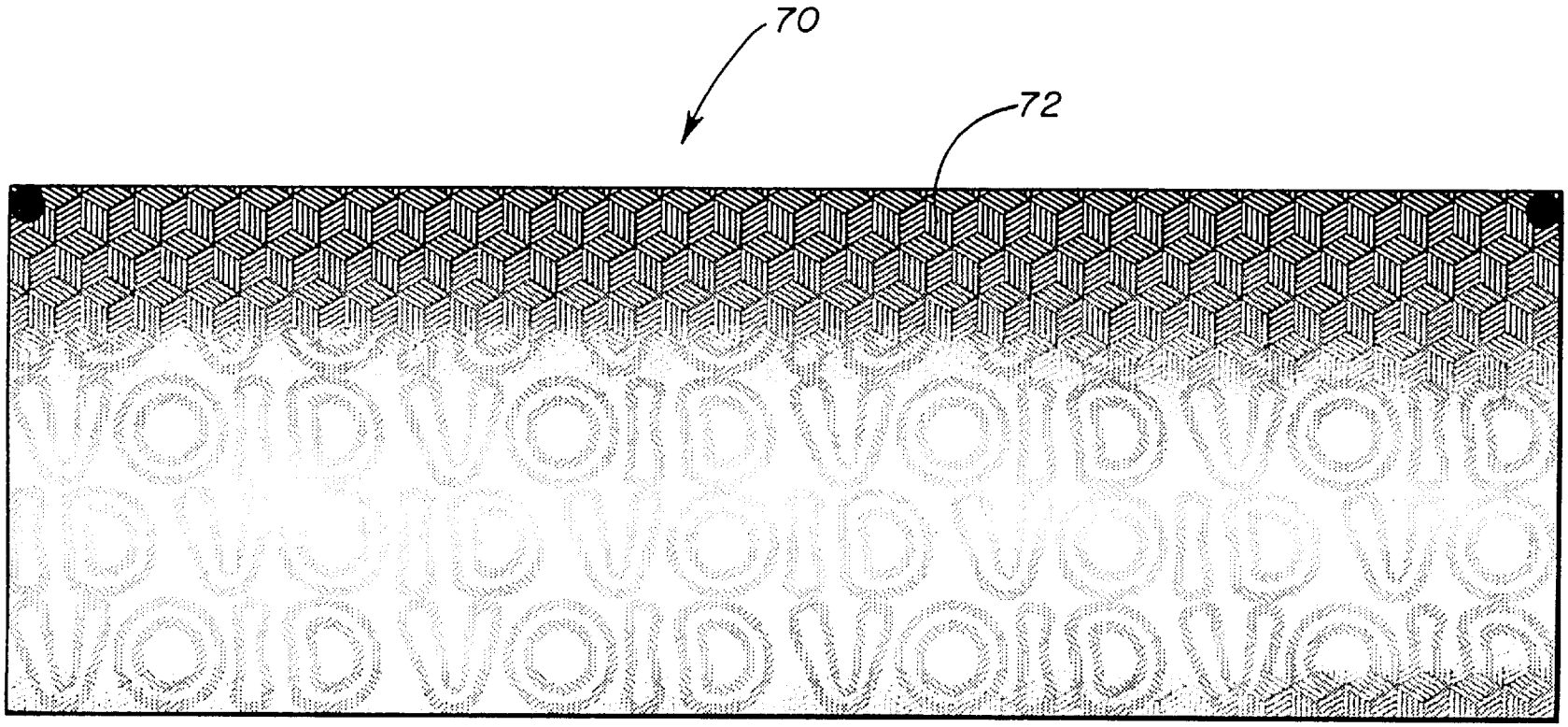
FIGS. 11, 12 and 13 illustrate another embodiment of the present invention.
Figure 12:
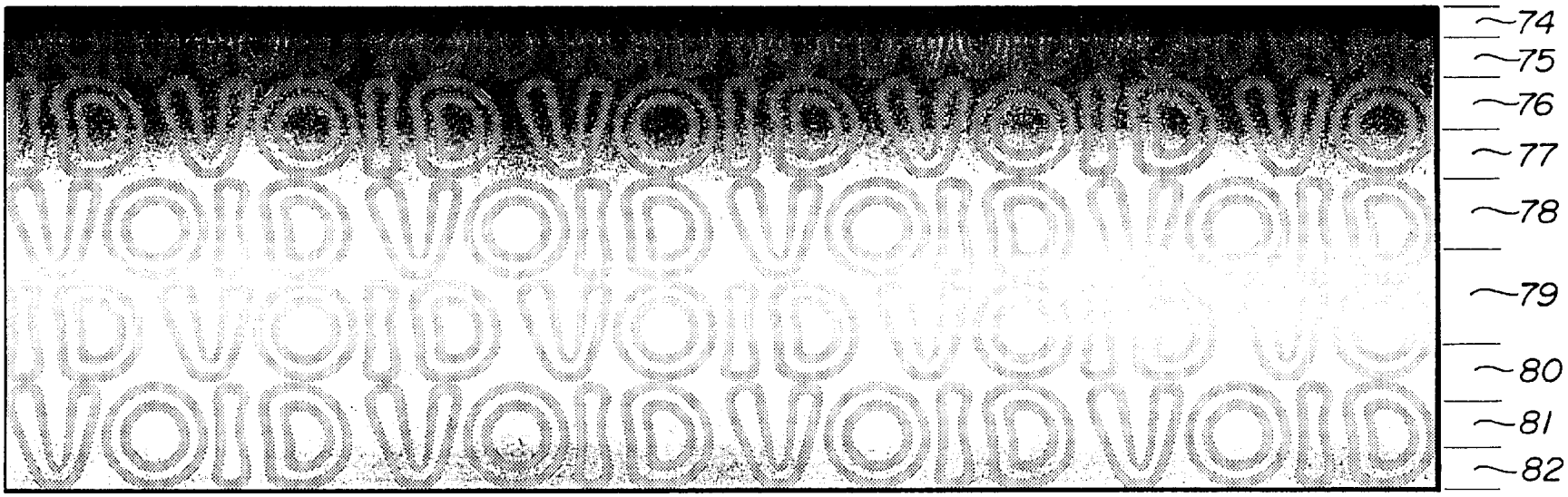
Figure 13:
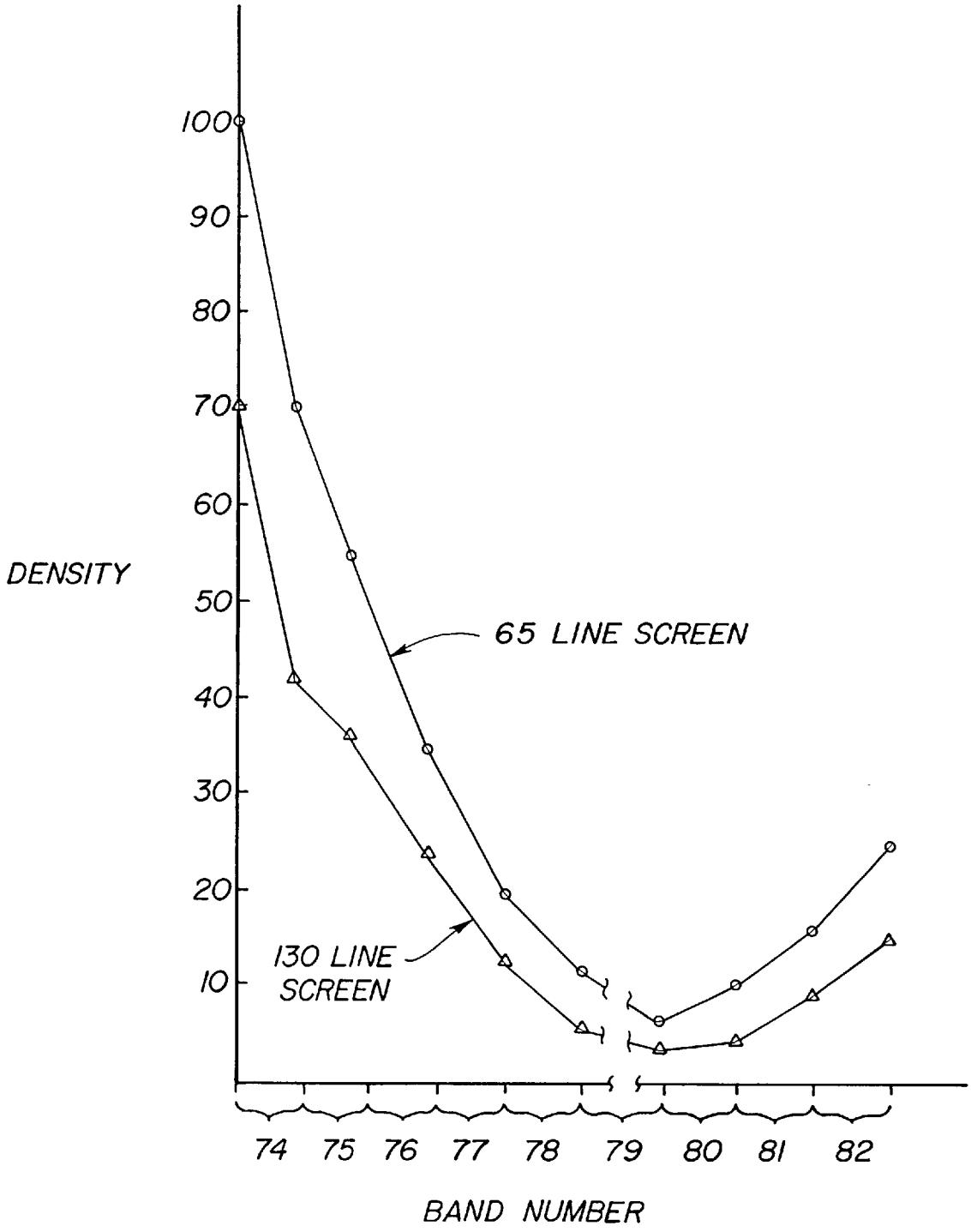

The present invention may be incorporated in a number of different security documents of varying design. FIGS. 11–13 illustrate yet another embodiment of the present invention. FIG. 11 shows the improved security document 70 with all alphanumeric printed matter removed, leaving only the half-tone background image, the half-tone warning image, and the camouflage image printed on the substrate 72 having a surface for receiving printed indicia. The half-tone background image consists of a pattern of elements of a first size and a first frequency such that the half-tone background image is printed at a first density perceived by an observer as a first tone. The half-tone warning image consists of a pattern of elements of a second size and a second frequency such that the half-tone warning image is printed at a second density perceived by an observer as a second tone. As discussed more fully below, the first and second tones may generally be the same across the face of the security document. As with the embodiments previously discussed, elements of one of the first size or the second size are sufficiently small such that they are not reproduced by a color copier at a particular copier setting, and elements of the other of the first size or the second size are sufficiently large such that they are reproduced by the color copier at the particular copier setting. As a consequence, a copy of the security document made on a color copier displays the half-tone warning image.

In this embodiment, the security document surface is divisible into a plurality of bands extending across the surface. This is more clearly shown in FIGS. 12 and 13, with the bands being designated by reference numerals 74 through 82. The document is illustrated with the entire surface divided into bands, but it should be understood that only a portion of the surface may be divided in this manner, if desired. Furthermore, the document is illustrated with the bands extending across the entire width of the document. If desired, however, other arrangements, such as non-parallel bands, extending radially outward from a common point, may be utilized. FIG. 12 illustrates the document of FIG. 11 as it would appear without the camouflage image, while FIG. 13 graphically depicts the change in densities of the areas printed with the first and second size elements. Note that the sizes of the elements of the first and second sizes vary across each of the bands. As a consequence, the density of the half-tone background image and the density of the half-tone warning image vary together across each of the bands on the surface in a direction generally normal to the bands. By this arrangement, copying the security document without the half-tone warning image being apparent on at least some portion of the copy is impeded. It should be appreciated that in some instances the size of the elements of the first and second sizes will vary across less than all of the bands.

The camouflage image, defined by the absence of the elements of the first and second sizes in a pattern simulating blocks, disguises the half-tone warning image quite well. The degree to which this disguise is successful can be easily seen by comparing FIGS. 11 and 12.

It should be appreciated that any of a wide variety of camouflage images may be utilized in this fashion to disguise the half-tone warning images on a security document according to the present invention. For a camouflage to be effective, the camouflage image usually occupies about 50% of the document surface area. A properly configured camouflage image becomes the dominant image in the eye of the casual observer. Although a camouflage image defined by the absence of elements is shown in FIG. 11, it will be understood that a camouflage image may also be defined by the presence of further elements.

As is apparent from FIG. 12, the half-tone warning image consists of a plurality of letters, each of which is approximately two bands in height. Actually, a plurality of half-tone warning images are printed, with each half-tone warning image being printed over an associated pair of the plurality of bands. Specifically, the half-tone warning image consists of the word "VOID" repeated numerous times along each of the bands 74–82. Although the x-axis of FIG. 13 is not drawn to scale, it will be appreciated that the plurality of half-tone warning images and the plurality of bands 74–82 vary in height. Band 79 is generally twice as high as the other bands.

A careful inspection of FIG. 12 reveals that while the tone of the half-tone background image and the tone of the half-tone warning image are generally the same at each point on the document, still some differences between the tone of the half-tone background image and the tone of the half-tone warning image do exist. The density of each portion of the surface printed with those elements which are sufficiently large such that they are reproduced by the color copier at the particular copier setting is greater than the density of adjacent portions of the surface printed with elements which are sufficiently small such that they are not reproduced by a color copier at the particular copier setting. These differences in tone and density enhance the ability of the security document of the present invention to impede copying without the half-tone warning image being apparent on a least some portion of the copy. Even with these differences in density and tone, however, the half-tone warning images are sufficiently obscured by the camouflage image so as not to be apparent to the eye of a casual observer. It will be appreciated, however, that if desired the densities may be selected such that the tone of the half-tone background image and the tone of the half-tone warning image are the same at each point on the document.

As will be noted from a review of FIG. 13, the density of the half-tone background image and the density of the half-tone warning image vary together linearly across each of the plurality of bands. In some cases, however, the density of the half-tone background image and the density of the half-tone warning image will vary together only across some of the plurality of bands. In the illustrated document, the half-tone background image is printed with a 130 line per inch, half-tone dot screen, and the half-tone warning image is printed with a 65 line per inch, half-tone dot screen. The density of the half-tone warning image in band 74 is 100%, meaning full ink coverage at the top of the band, and drops to 70% at the bottom of the band. Similarly, the density of the half-tone background image in band 74 is 70% at the top of the band, and drops to 42% at the bottom of the band. Note that the density of the half-tone warning image in band 75 is 70% at the top of the band and drops to 55% at the bottom of the band. Similarly, the density of the half-tone background image in band 75 is 42% at the top of the band, and drops to 36% at the bottom of the band. The density of the half-tone background image and the density of the half-tone warning image along each edge of each of the bands 74 through 82 are substantially the same as the density of the half-tone background image and the density of the half-tone warning image along the edges of the adjacent bands, respectively. As a consequence, the transition from one band to the next is accomplished in a manner that is not readily apparent to a casual observer.

Figure 14:
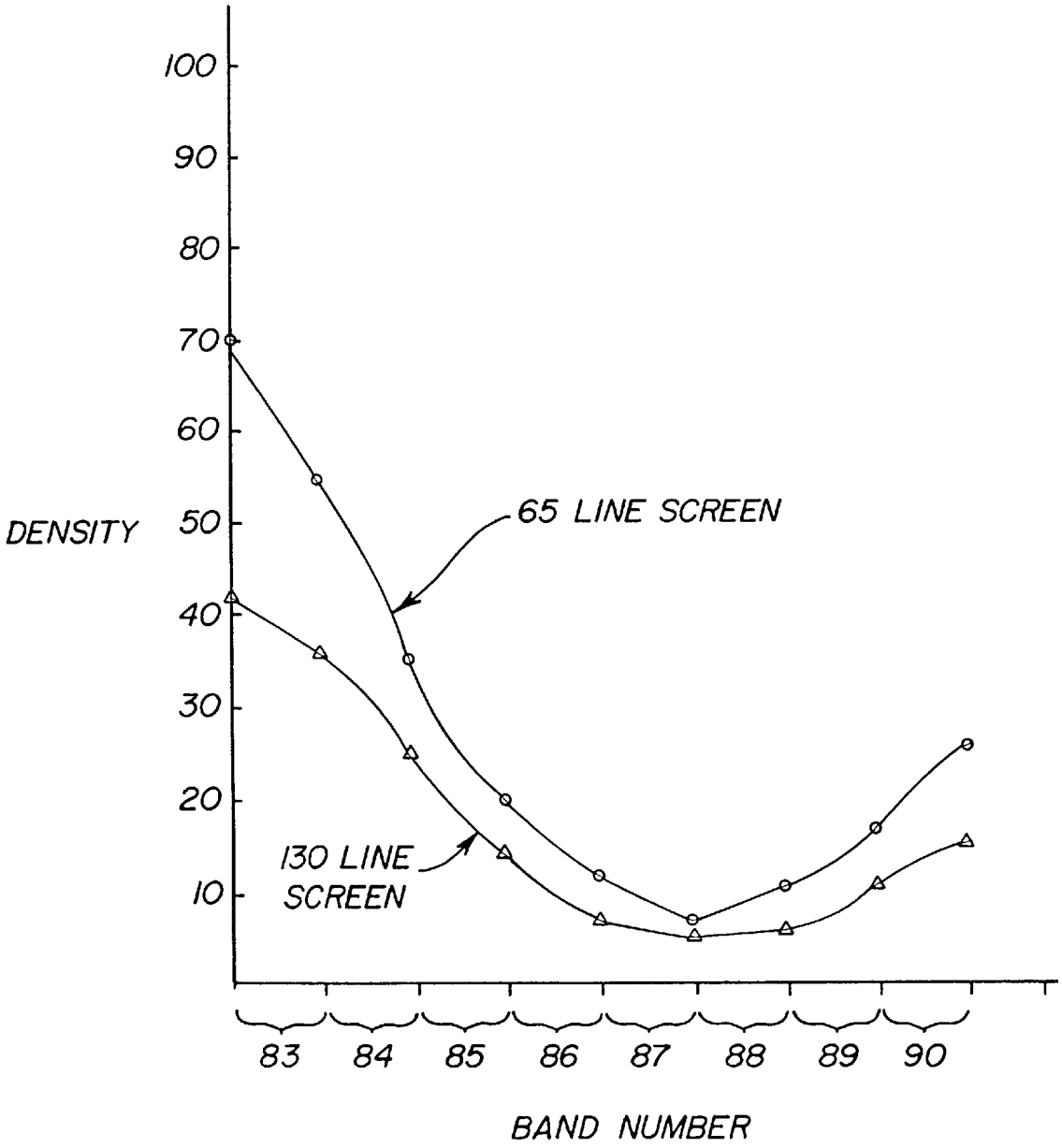
FIG. 14 illustrates graphically the changes in image density of yet another embodiment of the present invention.

The density of the security document may be varied in other ways. The density of the half-tone background image and the density of the half-tone warning image vary together in a non-linear fashion across at least some of the bands. Reference is made to FIG. 14, which illustrates the density changes in the half-tone background image and the half-tone warning images of a security document having eight bands 83–90. Band 83 extends across the top edge of the document and band 90 extends across the bottom edge of the document. In this example, the heights of the bands for a document which is the size of a typical check are as follows.

| Band | Height (inches) |
|---|---|
| 83 | .175 |
| 84 | .200 |
| 85 | .450 |
| 86 | .475 |
| 87 | .500 |
| 88 | .450 |
| 89 | .225 |
| 90 | .211 |

In this example, the half-tone background image is printed with a 130 line per inch, half-tone dot screen at a 450° screen angle, and the half-tone warning image is printed with a 65 line per inch, half-tone dot screen at a 450° screen angle. The density values are as follows.

| Band | Half-tone warning image | | | | A half-tone background image | | | |
|---|---|---|---|---|---|---|---|---|
| number | Taper | Start | Stop | Direct | Taper | Start | Stop | Direct |
| 83 | LIN | 55 | 70 | 90 | LIN | 36 | 42 | 90 |
| 84 | LOG | 35 | 55 | 90 | LOG | 25 | 36 | 90 |
| 85 | LOG | 35 | 20 | 270 | LOG | 25 | 14 | 270 |
| 86 | LOG | 20 | 12 | 270 | LOG | 14 | 7 | 270 |
| 87 | LIN | 12 | 7 | 270 | LIN | 7 | 5 | 270 |
| 88 | LIN | 11 | 7 | 90 | LIN | 6 | 5 | 90 |
| 89 | LOG | 17 | 11 | 90 | LOG | 11 | 6 | 90 |
| 90 | LOG | 17 | 26 | 270 | LOG | 11 | 16 | 270 |

In this table, the abbreviations used are as follows.

"Taper" indicates the type of change of the graduated screen between the start and the stop values. LIN indicates an equal change for equal distance increments between the start and stop boundaries. LOG indicates a more rapid change for equal distance increments closer to the start boundary and becoming progressively less closer to the stop boundary. It should be noted that the density of the half-tone background image and the density of the half-tone warning image vary together in a logarithmic manner across at least some of the plurality of bands.

"Start" is the screen percentage selected to start the band. It may be at the top or bottom of the band depending on the direction of taper.

"Stop" is the screen percentage selected to end the band. It may be at the top or bottom of the band depending on the direction of taper.

"Direct" is the direction of change in element sizes between the start and stop boundaries. A notation of 270 means that the values change from the start value at the top of the band to the stop value at the bottom of the band. A notation of 90 means that the values change form the start value at the bottom of the band to the stop value at the top of the band.

In a preferred embodiment of the present invention, ten bands 200–209 are provided, extending laterally across the document, with the density values being set as follows.

| Band | Half-tone warning image | | | | A half-tone background image | | | |
|---|---|---|---|---|---|---|---|---|
| number | Taper | Start | Stop | Direct | Taper | Start | Stop | Direct |
| 200 | LOG | 32 | 46 | 90 | LOG | 21 | 29 | 90 |
| 201 | LIN | 32 | 23 | 270 | LIN | 21 | 14 | 270 |
| 202 | LIN | 23 | 14 | 270 | LIN | 14 | 08 | 270 |
| 203 | LIN | 14 | 08 | 270 | LIN | 08 | 04 | 270 |
| 204 | LOG | 08 | 06 | 270 | LOG | 04 | 03 | 270 |
| 205 | LOG | 07 | 06 | 90 | LOG | 04 | 03 | 90 |
| 206 | LIN | 11 | 07 | 90 | LIN | 05 | 04 | 90 |
| 207 | LIN | 16 | 11 | 90 | LIN | 09 | 05 | 90 |
| 208 | LIN | 24 | 16 | 90 | LIN | 13 | 09 | 90 |
| 209 | LIN | 33 | 24 | 90 | LIN | 19 | 13 | 90 |

It is preferred to prepare the images that are subsequently printed on a security document using a personal computer and drafting software entitled FREEHAND 3.1, available from Aldus Co. This software permits the boundary densities to be precisely controlled. It is preferred that the images are then printed out from the personal computer using an imager having 3000 dots per inch, or greater, resolution. Using these printed images, printing of the security documents is then accomplished in a conventional manner, taking care to follow good commercial printing practices to produce a quality image. This includes using quality inks that are dense in color and that do not produce undue dot gain.

If desired, a security document according to the present invention may be printed in more than one color ink. It has been found to be desirable to print the upper or lower bands of a document with a blue ink, and the remaining bands with a green ink. With a document in which the tone becomes progressively lighter toward the center portion of the document, the transition from blue to green is very subtle, and the color of the half-tone background image and the color of the half-tone warning image appear to vary together over the surface. This technique permits the printing of a document in which a gradual blending of the colors is approximated.

To facilitate the blending of colors, overlapping of areas printed with the two colors is accomplished. As an example, if the upper half of a document is printed with blue ink and the lower half of the document is printed with green ink, the bottom band of the upper half of the document may also be printed with green ink. Preferably, this bottom band is printed only with smaller elements, and the screen angle of these smaller elements differs from the screen angle of the elements printed in blue ink. For example, elements printed in blue ink may have a screen angle of 90°, whereas elements printed in green ink may have a screen angle of 45°. A similar arrangement is provided for the upper band of the bottom half of the document. By this technique, the blue and green elements are, for the most part, not printed on top of each other, and both colors are visible.

It will be appreciated that differing arrangements may be utilized within the scope of the present invention to cause of the tone of the half-tone background image and the tone of the half-tone warning image or terms to vary across at least some of the bands. For example, in another embodiment the sizes of the elements of the first and second sizes may vary across each of the bands and the frequencies of the elements of the first and second frequency may vary across each of the bands. In this embodiment, the density of the half-tone background image and the density of the half-tone warning image vary together across each of the bands on the surface in a direction generally normal to the bands. In yet another embodiment, only the frequencies of the elements of the first and the second frequency varying across at least some of the bands such that the density of the half-tone background image and the density of the half-tone warning image vary together across at least some of the bands on the surface in a direction generally normal to the bands.

It will be further appreciated that it may be desirable in some instances to provide an area of the document of the present invention with a half-tone background image and half-tone warning images that do not vary in tone. This may be the case, where a uniformly light tone is desired to facilitate reading information that is to be printed later in this area. Further, it may be desirable in some instances to provide an area of the document without any of the larger sized elements that make up either the half-tone background image or the half-tone warning images. This may be the case where it is desired to print machine readable characters in this area, and the larger elements may impede character recognition.

Figure 15:
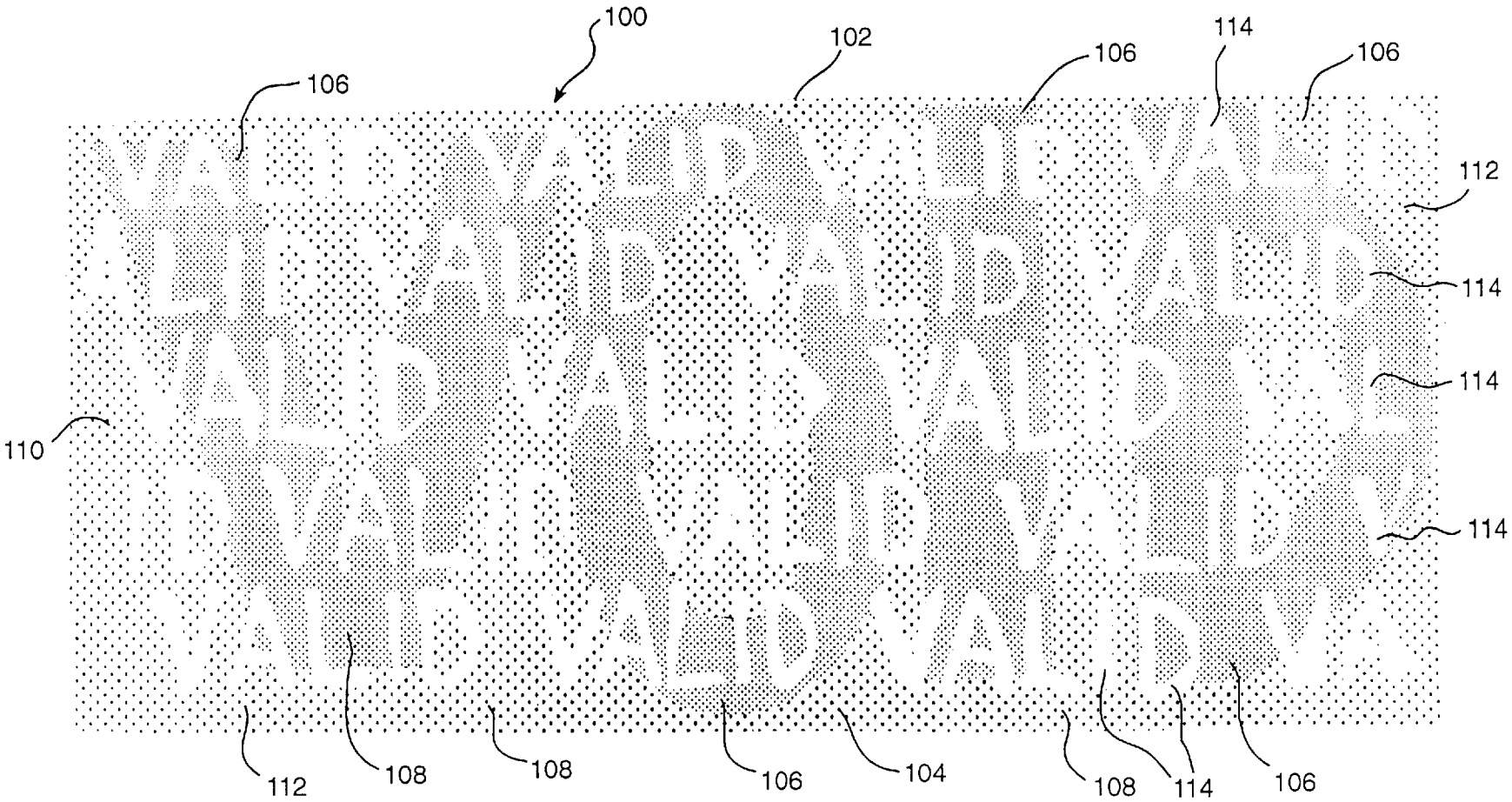
FIGS. 15 is an illustration of another embodiment of the present invention.
Figure 15A:
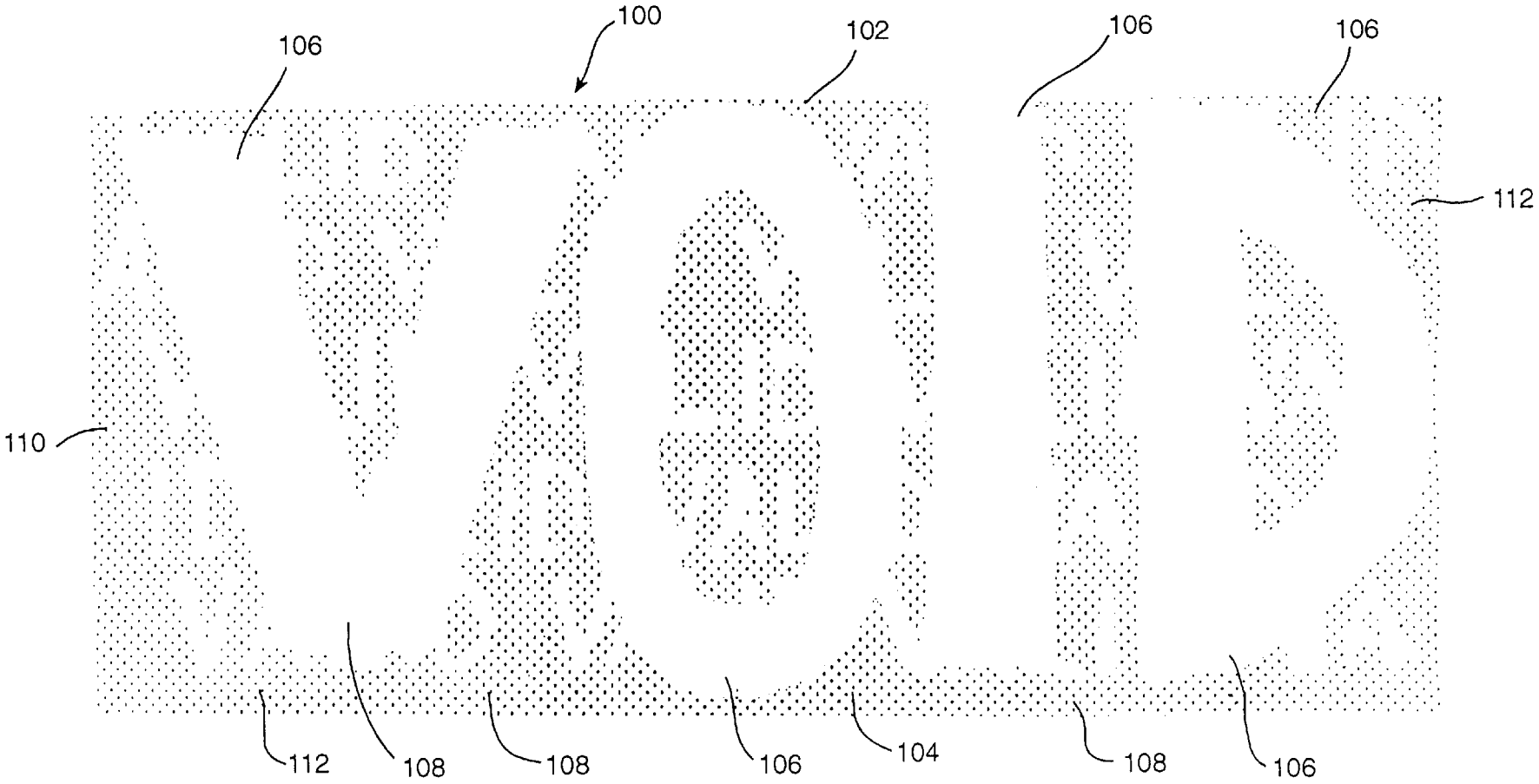
FIG. 15A depicts the appearance of a copy of the document of FIG. 15 obtained on a color copier or desk top publishing system.

Reference is now made to FIGS. 15 and 15A, which illustrate yet another embodiment of the present invention. It will be appreciated that these figures are not drawn to scale; rather, for purposes of clarity, the half-tone elements have been illustrated as larger and more widely spaced than would actually be the case. As seen in FIG. 15, the security document 100 includes a document substrate 102 having a surface 104 for receiving printed indicia. A half-tone warning image 106 is printed in first areas 108 on the surface 104. The warning image 106 consists of at least one word indicating that a copy of the document is not an original document. In the example shown in FIG. 15, the warning image 106 consists of the letters making up the word "VOID". A half-tone background image 110 is printed in second areas 112 on the surface 104 which surround the first areas 108. Either the half-tone warning image 106 or the half-tone background image 110 is printed with half-tone elements of such a line spacing and element size that it is not readily reproducible by a copier. As a result, the half-tone warning image 106 becomes apparent on photocopies of the original document that may be made, either as a positive image or as a reverse image. In the embodiment of FIG. 15, the half-tone warning image 108 is printed with half-tone elements that are not readily reproducible by a copier.

The embodiment of FIG. 15 is shown as having relatively large dots making up the background image 110, perhaps at a line screen of 65 lines per inch, and relatively small dots making up the half-tone warning image 106, perhaps at a line screen of 130 lines per inch. The densities of the half-tone background image and the half-tone warning image are selected to provide generally the same tone for the two images on the original document. Thus, the warning image 106 on the document 100 is not apparent to the eye of a casual observer. To obscure the warning image even further, a camouflage image 114 is provided. Camouflage image 114 extends over the document surface 102 for confusing the eye of an observer such that the warning image 106 is not readily observed. The camouflage image 114 of this embodiment performs the additional function of indicating to an observer that the document is an original document. The camouflage image 114 preferably comprises at least one word that provides this indication.

In the illustrated example, the camouflage image 114 comprises the word "VALID" which is repeated across the document surface. The camouflage image 114 may be defined by portions of the first and second areas 108 and 112, respectively, in which half-tone elements are not printed, as shown by FIG. 15. Alternatively, the camouflage image 114 may be defined by portions of only the first areas in which half-tone elements are not printed, or by portions of only the second areas in which half-tone elements are not printed.

Note that the camouflage image message, "VALID," is quite prominent in FIG. 15. Thus the recipient of the security document 100 is given confidence in the authenticity of the document. Not only does the recipient not see an indication of invalidity, but the recipient sees a positive indication that the document is valid. When a copy is made of the document, such as for example a copy on a color copier, the elements making up the half-tone warning image 106 are sufficiently small that they are not adequately reproduced on the copy, and may not copy at all. As a consequence, the warning image "VOID" appears prominently on the photocopy, as illustrated in FIG. 15A, telling the recipient that the document is not an original document. As will be noted from FIGS. 15 and 15A, the camouflage image "VALID" is repeated a plurality of times over the larger warning image "VOID." The warning image 106 is substantially larger than the camouflage image 114. By this arrangement, the word VALID is sufficiently prominent on the original document to be easily noticed by a casual observer, yet the warning image VOID predominates the photocopy of the document, even if remnants of the camouflage image may be found in the second areas 112.

A wide array of words are available to convey the information that the original document is an original, and that the photocopy of the document is a copy. It is preferable, of course, that the word used for the warning image and the word used for the camouflage image be antonyms. Word pairs such as "INVALID" and "VALID," "UNAUTHORIZED" and "AUTHORIZED," "COPY" and "ORIGINAL," "VOID" and "VALID," and "DUPLICATE" and "ORIGINAL," may be used for the warning image and the camouflage image, respectively. Other word pairs may also be utilized, including word pairs in which the words have dissimilar, but not necessarily opposite meanings, such as for example "COPYRIGHT VIOLATION" and "ORIGINAL." Further, symbols and other indicia may be employed as "words" within the context of the present invention.

If desired, the sizes of the half-tone elements making up the warning image and the background image may vary across the surface of the security document such that the density of the warning image and the density of the background image also vary together. In such an instance, the security document will have the same general appearance as that shown in FIG. 7, with the exception, of course, that the camouflage image will clearly advise the observer of the authenticity of the document. While it is preferred that the change in image tone across the document be accomplished by varying the size of the half-tone elements, it may also be effected by varying their spacing, or by varying both their size and their spacing across the face of the document. Regardless of the manner in which the varying tone document is produced, such a document is more difficult for a forger to copy without the warning image being apparent on at least some portion of the copy.

Figure 16:
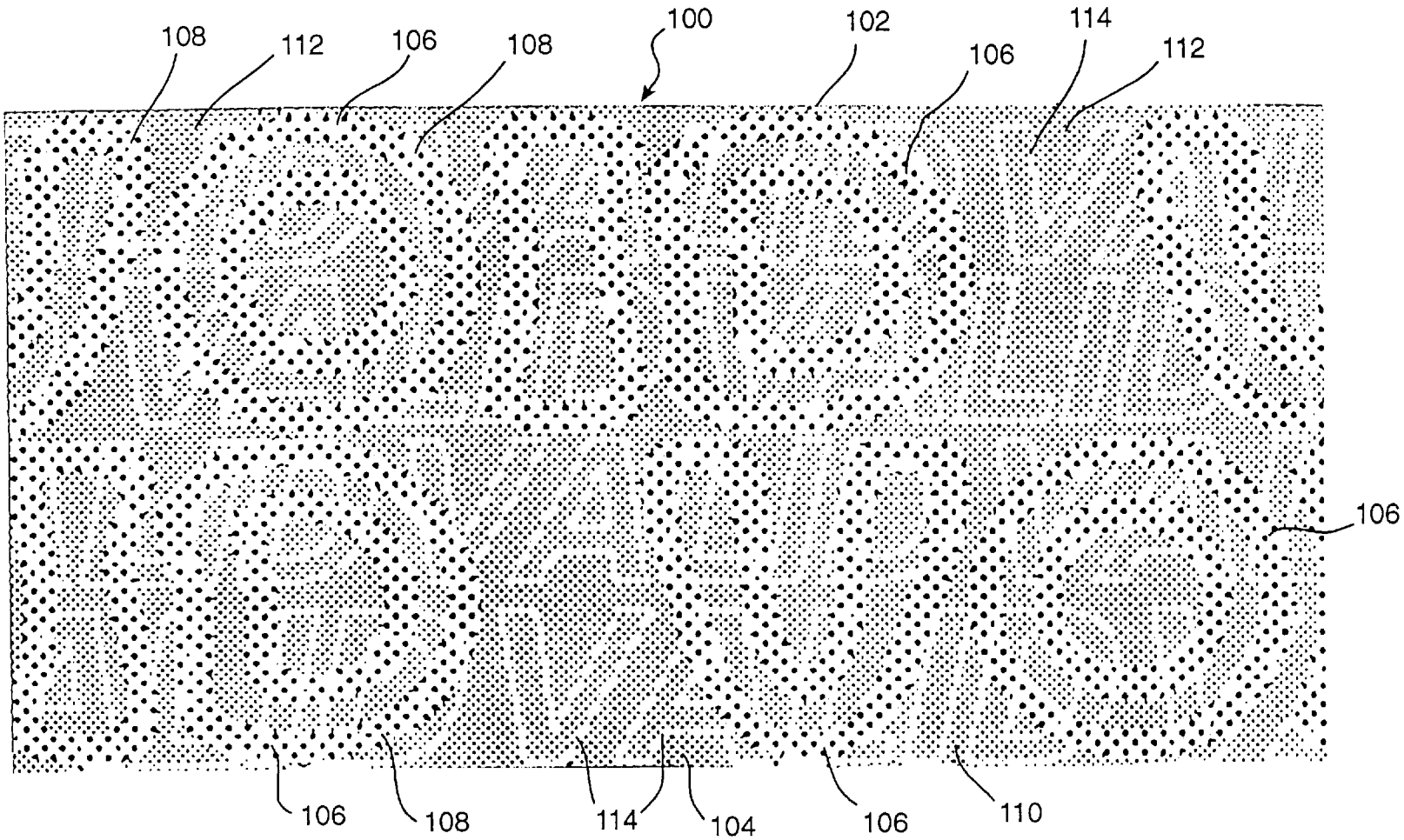
FIG. 16 is an illustration of yet another embodiment of the present invention.

Reference is now made to FIG. 16, which shows another embodiment of the security document of the present invention. In this embodiment, the same reference numerals are used as in the embodiment of FIG. 15 to designate like elements. The security document 100 includes a document substrate 102 having a surface 104 for receiving printed indicia. A half-tone warning image 106 is printed in first areas 108 on the surface 104. The warning image 106 consists of at least one word indicating that a copy of the document is not an original document. The warning image 106 consists of the letters making up the word "VOID" in outline form. A half-tone background image 110 is printed in second areas 112 on the surface 104 which surround the first areas 108.

The embodiment of FIG. 16 is shown as having relatively small dots making up the background image 110, perhaps at a line screen of 130 lines per inch, and relatively large dots making up the half-tone warning image 106, perhaps at a line screen of 65 lines per inch. A camouflage image 114 extends over the document surface 102 and confuses the eye of an observer such that the warning image 106 is not readily observed. Note that the camouflage image does not extend through the warning image. The elements making up the warning image are sufficiently separated, however, that this is not readily apparent. As with the previous embodiment, the camouflage image 114 performs the additional function of indicating to an observer that the document is an original document. The camouflage image 114 preferably comprises at least one word that provides this indication.

As is apparent from FIG. 16, the letters of the word making up the camouflage image 114 are outlined by areas in which no half-tone elements are printed. This use of outline letters as a camouflage is effective in that in those cases in which the camouflage image extends across the areas having the larger elements, the remnants of the camouflage image are less apparent on the copy of the document. This is preferable, of course, since it is desired that the camouflage image word be prominent on the original document and unnoticed on the copy of the document, if possible.

Having described the improved security document of the present invention in detail and by reference to different embodiments thereof, it will be apparent that certain modifications and variations are possible without departing from the scope of the invention defined in the appended claims.

What is claimed is:

1. A security document, comprising:

a document substrate having a surface for receiving printed indicia;

first areas on said surface in which a half-tone warning image is printed, said warning image comprising at least one word indicating that a copy of the document is not an original document;

second areas on said surface in which a half-tone background image is printed, said second areas surrounding said first areas; and a camouflage image extending over said document surface for confusing the eye of an observer such that said warning image is not readily observed, said camouflage image comprising at least one word indicating to an observer that the document is an original document, one of said half-tone warning image and said half-tone background image being printed with half-tone elements of such a line spacing and element size that it is not readily reproducible by a copier whereby said half-tone warning image becomes apparent on a copy of an original document.

2. The security document of claim 1 in which said camouflage image is defined by portions of said first areas in which half-tone elements are not printed.

3. The security document of claim 1 in which said camouflage image is defined by portions of said second areas in which half-tone elements are not printed.

4. The security document of claim 1 in which said camouflage image is defined by portions of said first and second areas in which half-tone elements are not printed.

5. The security document of claim 1 in which said warning image and said camouflage image comprise words which are antonyms.

6. The security document of claim 5 in which said warning image and said camouflage image comprise the words INVALID and VALID, respectively.

7. The security document of claim 5 in which said warning image and said camouflage image comprise the words UNAUTHORIZED and AUTHORIZED, respectively.

8. The security document of claim 5 in which said warning image and said camouflage image comprise the words COPY and ORIGINAL, respectively.

9. The security document of claim 5 in which said warning image and said camouflage image comprise the words VOID and VALID, respectively.

10. The security document of claim 5 in which said warning image and said camouflage image comprise the words DUPLICATE and ORIGINAL, respectively.

11. The security document of claim 1 in which the sizes of the half-tone elements making up said warning image and said background image vary across said surface such that the density of said warning image and the density of said background image vary together across said surface, thereby impeding copying said security document without said warning image being apparent on at least some portion of the copy of said security document.

12. The security document of claim 1 in which said warning image is substantially larger than said camouflage image, and in which said camouflage image is repeated a plurality of times over said warning image.

13. The security document of claim 1 in which the letters of the word making up said camouflage image are outlined by areas in which no half-tone elements are printed.

14. The security document of claim 13 in which said warning image is substantially larger than said camouflage image, and in which said camouflage image is repeated a plurality of times over said warning image.

15. A security document, comprising:

a document substrate having a surface for receiving printed indicia;

first areas on said surface in which a half-tone warning image is printed, said warning image comprising at least one word indicating a status of a copy of the document;

second areas on said surface in which a half-tone background image is printed, said second areas surrounding said first areas; and a camouflage image extending over said document surface for confusing the eye of an observer such that said warning image is not readily observed, said camouflage image comprising at least one word indicating to an observer a status of the original document, one of said half-tone warning image and said half-tone background image being printed with half-tone elements of such a line spacing and element size that it is not readily reproducible by a copier, whereby said half-tone warning image becomes apparent on a copy of an original document.

16. The security document of claim 15 in which said camouflage image is defined by portions of said first areas in which half-tone elements are not printed.

17. The security document of claim 15 in which said camouflage image is defined by portions of said second areas in which half-tone elements are not printed.

18. The security document of claim 15 in which said camouflage image is defined by portions of said first and second areas in which half-tone elements are not printed.

19. The security document of claim 15 in which said warning image and said camouflage image comprise words which are antonyms.

20. The security document of claim 15 in which the sizes of the half-tone elements making up said warning image and said background image vary across said surface such that the density of said warning image and the density of said background image vary together across said surface, thereby impeding copying said security document without said warning image being apparent on at least some portion of the copy of said security document.

21. The security document of claim 15 in which said warning image is substantially larger than said camouflage image, and in which said camouflage image is repeated a plurality of times over said warning image.

22. The security document of claim 15 in which the letters of the word making up said camouflage image are outlined by areas in which no half-tone elements are printed.

23. The security document of claim 22 in which said warning image is substantially larger than said camouflage image, and in which said camouflage image is repeated a plurality of times over said warning image.

* * * * *